US005423276A

United States Patent [19]

Nishimura

[11] Patent Number: 5,423,276

[45] Date of Patent: Jun. 13, 1995

[54] CAMBER CONTROL SAIL SYSTEM

[76] Inventor: Thomas G. Nishimura, 3770 Lurline Dr., Honolulu, Hi. 96816

[21] Appl. No.: 231,109

[22] Filed: Apr. 22, 1994

[51] Int. Cl.[6] ..... B63H 9/08

[52] U.S. Cl. ..... 114/39.2; 114/98; 114/102

[58] Field of Search ..... 114/39.1, 39.2, 102, 114/103, 104, 109, 98

[56] References Cited

U.S. PATENT DOCUMENTS

| | | | |
|---|---|---|---|
| 4,501,216 | 3/1985 | Voslamber | 114/102 |
| 4,625,671 | 5/1986 | Nishimura | 114/103 |
| 4,708,076 | 1/1987 | Lekhtman | 114/39.2 |

*Primary Examiner*—Jesus D. Sotelo

[57] ABSTRACT

An improved sail (20) is attached along its luff portion to a mast (26). A pair of control battens (34) extend across the sail (20). A forward camber control handle (36) attaches to the mast (26) and an aft camber control handle (44) secures to the sail (20) aft of the sail center of effort such that rotation of the forward handle (36) relative to the aft handle (44) effects bending of the control battens (34). The forward and aft control handles (36, 44) allow the sailor to alter and control sail camber instantaneously for various sailing objectives without removing hands from the handles (36, 44), while also allowing the alignment of sailor body mass with the sail system center of effort during wave jumping.

10 Claims, 13 Drawing Sheets

CAMBER CONTROL SAIL SYSTEM

BACKGROUND-FIELD OF INVENTION

This invention relates to sails and sailing systems generally, and in particular, to an improved sail system that permits the sailor to directly control the degree of sail camber or curvature while sailing.

Heretofore the free sail systems commonly employed in board sailing, have relied on downhaul and outhaul tensioning of the sail at the time of rigging for the setting of sail camber. Once rigged, the sailor's manipulation of the sail is limited to varying sail angle of attack, sail heel, and rake.

The additional ability to alter and control sail camber while under way is desired. For instance, a less cambered sail is preferable while sailing close to the wind whereas a more cambered sail maximizes thrust and speed when sailing off the wind. For sailboard wave jumping, using a more cambered sail obtains a higher jump, but may not be suitable for sailing prior to and after jumps. When sailing in variable wind conditions, it is desirable to use less camber during wind gusts.

A primary object of the present invention is to provide a sail system which allows the sailor to vary the degree of sail camber while underway.

There are presently available devices which effect small changes in sail camber when sailing vehicles are underway. Camber inducers found on slalom free sail systems, for example, act to transfer loads from the mast to the batten enhancing batten bend and producing a more camber stable sail. However wind speed and mast and batten stiffness determine the degree of camber stability such devices are capable of producing.

A second object of the present invention is to provide a sail system which allows the sailor to vary the amount of sail camber while underway, irrespective of wind conditions.

Prior art efforts to allow sailors to vary sail tension while sailing have included the tensioning of outhaul and downhaul using lines, worm gears or hydraulic pumps. Such methods involve significant lag time to actuate and require the sailor to release at least one hand from the boom. Varying sail camber reflexively in response to wind gusts cannot be effected using these prior art methods.

It is a further object of the present invention to provide a sail system which allows the sailor to vary sail camber immediately, with little effort and without requiring the sailor to release his or her hands from the sail controls.

Most available sail systems have a boom which attaches to the clew of the sail. This conventional sail configuration causes the draft to move aft, and the LE portion of the sail to collapse, whenever the sail is held at a low angle of attack in moderate or stronger winds. Sails are held at low angles of attack, for example, when counterbalancing moderate or heavy wind conditions. Thus as wind speed increases the sail draft continues to move aft while the luff portion collapses, until the sail becomes uncontrollable.

It is a further object of the present invention to provide a sail system wherein the sailor can maintain the draft in the LE portion of the sail and release the aft portion of the sail during low angles of attack and despite increasing wind conditions.

Presently, sailors select sail sizes depending upon wind conditions. Small sized sails are employed during high wind conditions, and larger sizes for light winds. In variable wind conditions, sailors often find themselves either over or underpowered or both.

It is a further object of the present invention to provide a sail system which may be employed efficiently in variable wind conditions such that the sailor has better sail control during wind gusts, yet is not underpowered in moderate wind.

Conventional sailboards employ a wishbone boom firmly attached to a mast. This traditional configuration maintains the alignment of the sail tack and head directly behind the mast and causes the aerodynamics of the sail head and tack regions to behave less efficiently compared with the remainder of the sail luff.

It is a further object of the present invention to provide a sail system for sailboards having increased aerodynamic efficiency along the head and tack regions by virtue of demonstrating a more continuous camber along its luff region.

Prior art sails employed in sailboarding tend to roll, rather than glide, when wave jumping. This roll tendency is caused by the sailor's inability to place his or her body mass beneath the sailing system's center of effort during jumping activities. One attempt to prevent the roll during sailboard jumping is disclosed in Nishimura U.S. Pat. No. 4,625,671, It is a further object of the present invention to disclose an alternative method for promoting balanced glides during sailboard wave jumping activities.

Sailboard free sail systems used in wave sailing often encounter extreme forces particularly when down in the waves. Wave pressure on the sail, which is held tautly between the boom and mast, subject the mast to great stress to the point of breaking. It is a further object of the present invention to provide a more flexible and forgiving sail system less subject to mast breakage when dropped in large wave conditions.

These and other objects are accomplished in the present invention, a camber control sail system comprising a sail, a mast, and a set of camber control handles extending from each side of the sail. The sail is attached to the mast along its luff portion. One camber control handle extends from the mast, a second handle extends from the sail aft of the first handle. In most embodiments, one or more control battens traverse the sail at a level intersecting the control handles.

The camber control sail system allows the sailor to control sail camber instantaneously, without releasing control apparatus, in a variety of wind conditions. Accordingly, the sailor can adjust sail camber for wind gusts irrespective of angle of attack, as well as for wave jumping and other maneuvers. The camber control sail system facilitates a more uniform camber along the entire luff portion of the sail contributing to the aerodynamic efficiency of the head and tack regions. The present invention, when employed on sailboards, promotes a controlled glide during wave jumping and renders mast breakage less likely in large wave conditions. Further objects and advantages of this invention will become apparent from a consideration of the drawings and ensuing descriptions.

DESCRIPTION OF INVENTION

Figure 1:
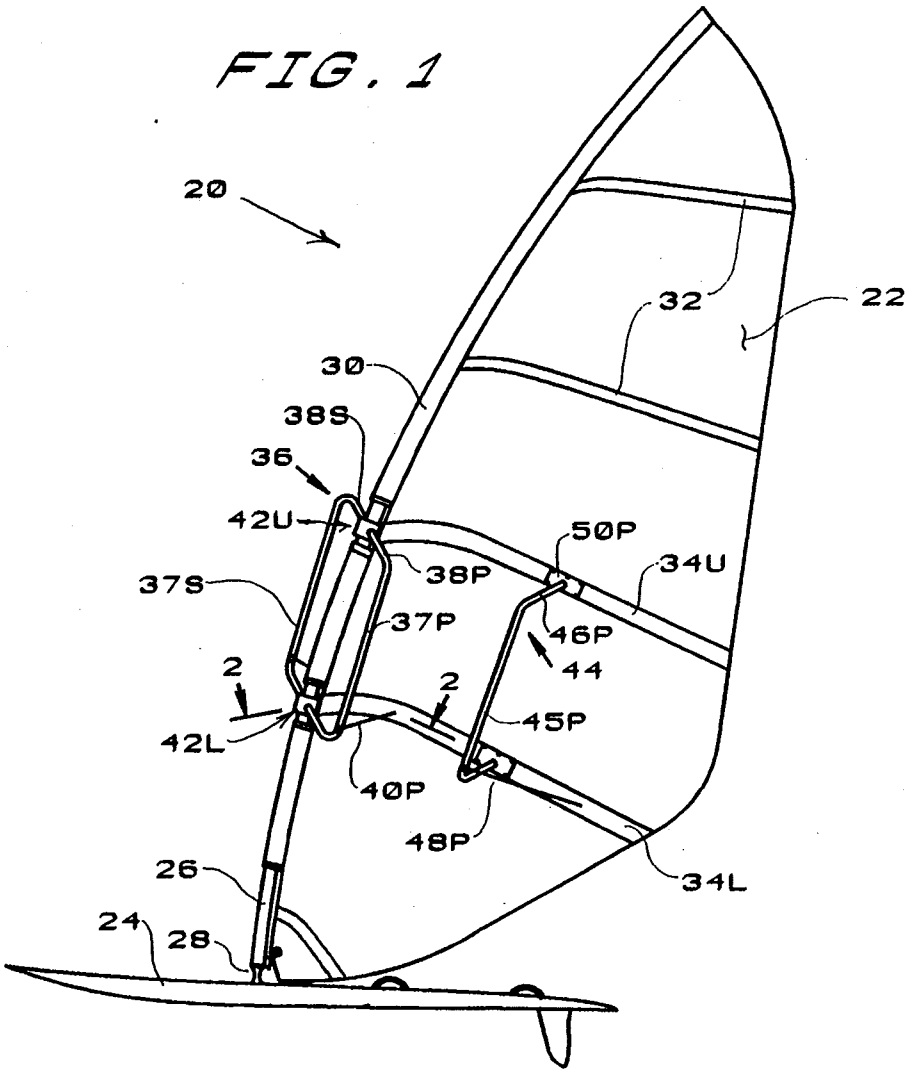
FIG. 1 is a side plan view of the present invention.

FIG. 1 shows a side view of a basic embodiment of the present invention including a sail 20 attached to a sailboard 24. Sail 20 is composed of a sail body 22, which can be of a synthetic fabric or film as is commonly used in sail making. A plurality of battens 32, an upper control batten 34U, and a lower control batten 34L are generally tapered towards the leading edge and are constructed of fiberglass and/or carbon fiber and attached across sail body 22. A mast sleeve 30 encircles a mast 26 which is attached to sailboard 24 by a universal joint 28. A forward camber control handle 36 comprises a port and a starboard forward vertical handle 37P, 37S, with a pair of port and a pair of starboard forward lever arms 38P, 38S extending from each end, respectively. Forward arms 38P, 38S are secured into a lower and an upper forward lever clamp 42L, 42U, respectively, which are best shown in FIG. 2.

Figure 6A:
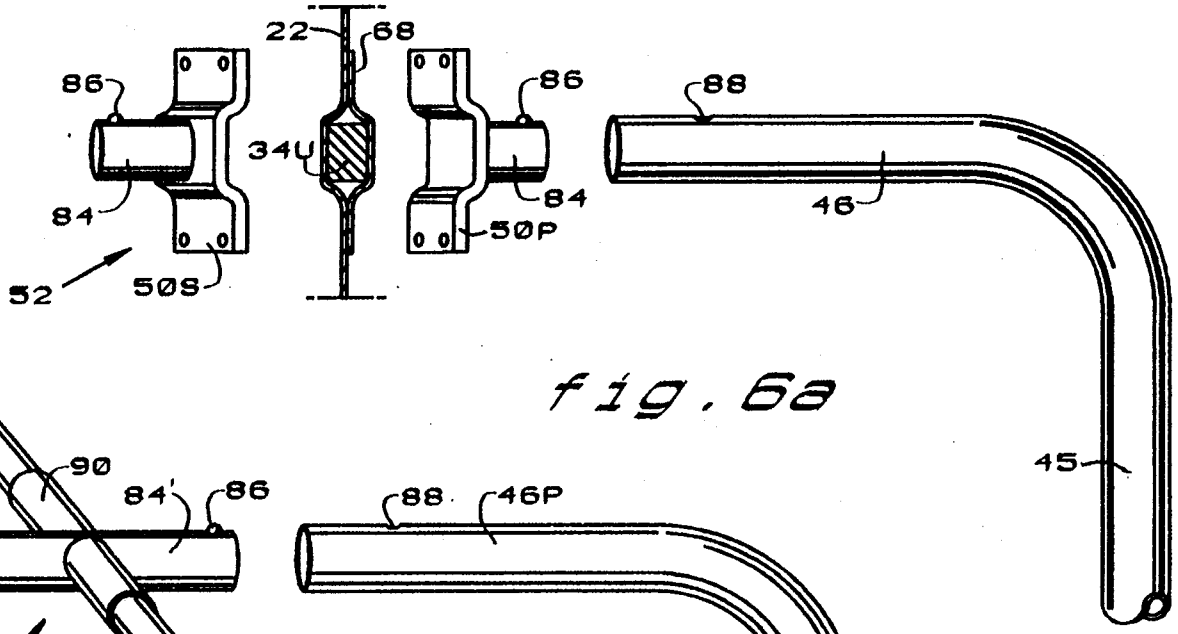
FIG. 6*a* is a front view of the first preferred embodiment of the aft lever bracket assembly of the present invention.

Aft handle 44 comprises a port and a starboard aft vertical bar 45P, 45S with a pair of port and a pair of starboard aft lever arms 46P, 46S extending from each end, respectively. Aft arms 46P, 46S are secured to a port and a starboard aft lever bracket 50P, 50S, respectively, which are best shown in FIG. 6*a*. Brackets 50P, 50S are secured over each side of sail body 22 and over control battens 34U, 34L and held together firmly with rivets or by other fasteners. Forward and aft handles 36, 44 can be bent from aluminum tubing or formed of a carbon fiber composite. Battens 32 can be of similar dimensions and stiffness to those battens commonly used in board sails. A forward batten portion 94 of control batten 34L and 34U will be flexible and usually tapered, but usually at least as stiff as the forward portions of battens 32, while the aft portions are considerably stiffer at the point of attachment of aft lever arms 44P, 44S. Control battens 34L, 34U can also taper from the point at which aft lever arms 46 are attached to their aft end.

Figure 2:
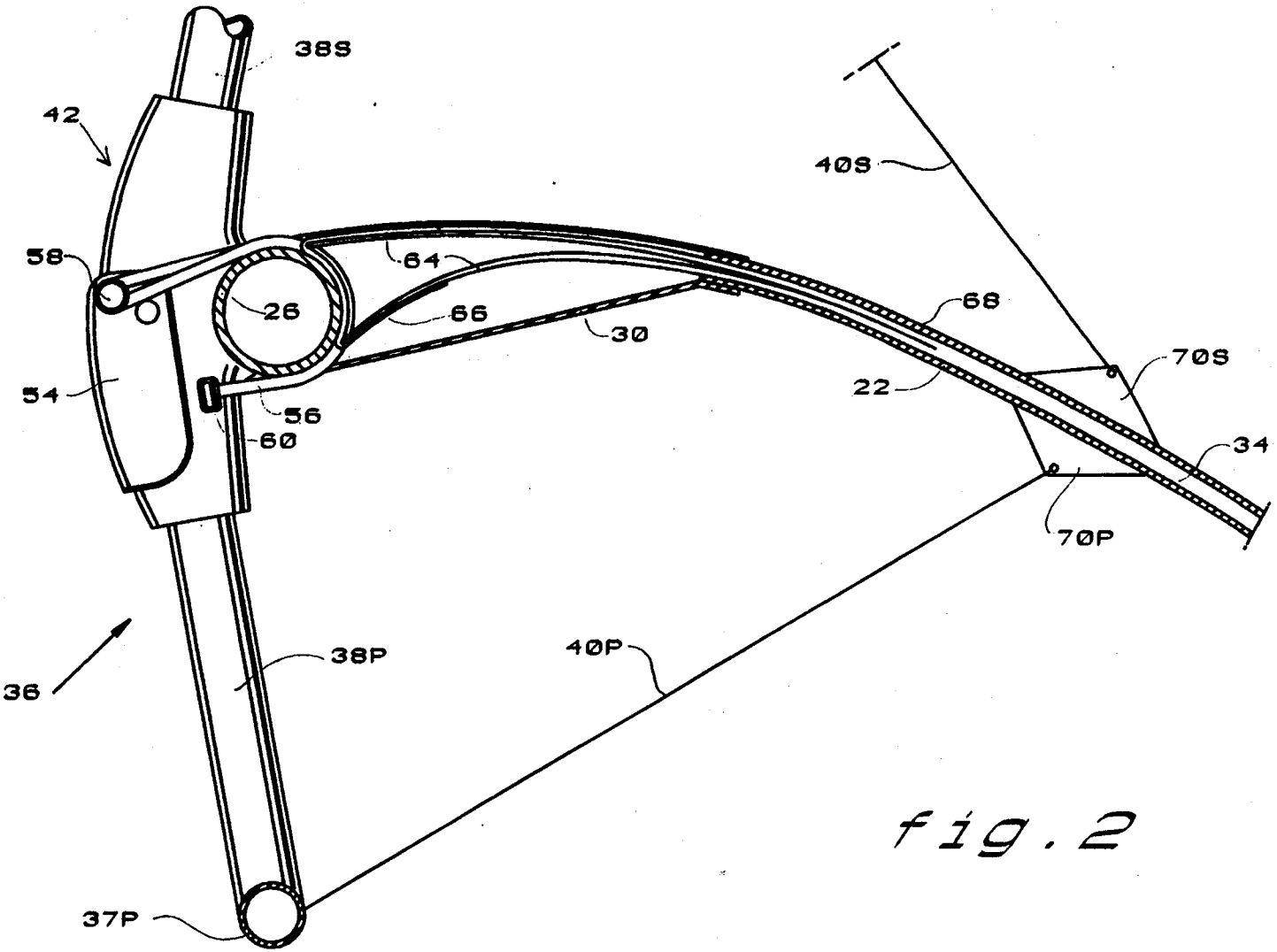
FIG. 2 is a view in detail of the first preferred embodiment of the Camber controlling mechanism of the present invention of a portion indicated by the section lines 2—2 in FIG. 1.

FIG. 2–5 depict alternate embodiments of forward camber handle 36. Referring to FIG. 2, a first preferred embodiment of forward camber handle 36 will be discussed. Forward handle 36 comprises vertical bars 37P, 37S, arms 38P, 38S, and clamp 42. Arms 38P and 38S secure into clamp 42 which attaches to mast 26 by a clamp line 56. Clamp 42 can be injected molded or machined from a plastic material such as nylon. Clamp line 56 can be a polyester braided line and is anchored at one end to a clamp line anchor 60 formed on clamp 42, and wraps around the aft side of mast 26 and loops over a clamp line post 58 which is secured to a clamp lever 54. A port and a starboard forward camber control line 40P, 40S are secured to handle 36 by any convenient method such as to an eye fitting (not shown) or by tying. Control lines 40P and 40S are secured at their other ends to a port and a starboard control line anchor 70P, 70S, respectively, which are sewn onto sail body 22 in close vicinity to control battens 34L. Alternatively, control lines 40P and 40S may be secured to sail 20 by attachment to grommets or other fittings. Sleeve 30 extends aft from mast 26 to enclose a split batten fork 64 which is the forward end of control batten 34. Control batten 34 is attached to sail body 22 by a batten pocket 68. Batten fork 64 is restrained from forward movement to mast 26 by a batten restraining strap 66 which is well known in the art. Control batten 34 will be located vertically adjacent forward clamp 42. Openings in sock 30 are placed to allow attachment of forward clamps 42U and 42L to mast 26.

Figure 3:
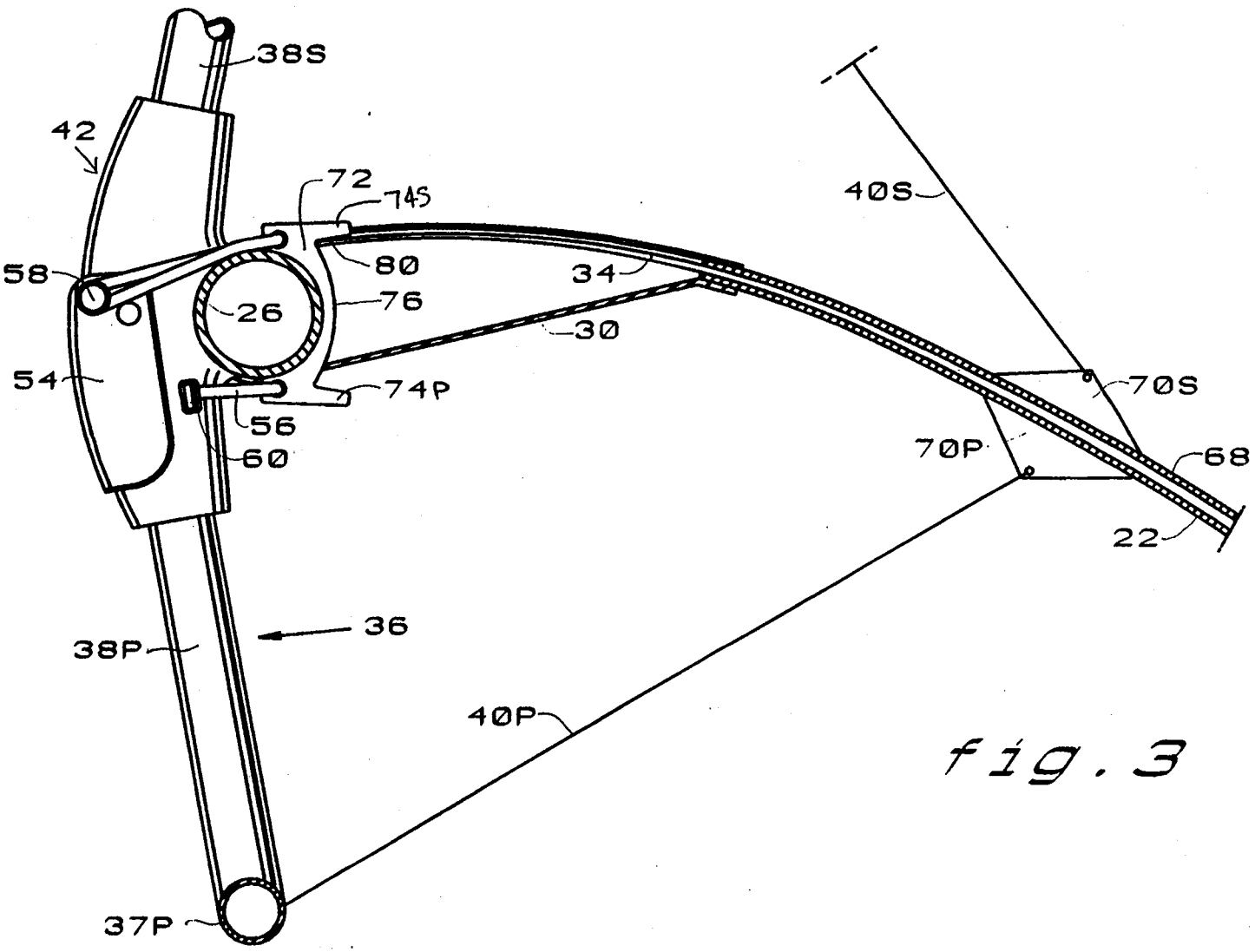
FIG. 3 is a view in detail of a second preferred embodiment of the camber controlling mechanism of the present invention of a portion indicated by the section lines 2—2 in FIG. 1.

Referring to FIG. 3, a second preferred embodiment of forward camber handle 36 comprises vertical bars 37P, 37S, lever arms 38P, 38S, forward clamp 42, a clamp backing 72, a starboard and a port batten restraining flange 74S, 74P, and a batten sliding surface 76. Clamp line 56 passes through holes in clamp backing 72 to forward clamp 42, securing it and clamp backing 72 to mast 26. A batten end 80 is the forward end of control batten 34 and rests on sliding surface 76 and against flange 74S or against flange 74P depending on the sailing tack.

Figure 4:
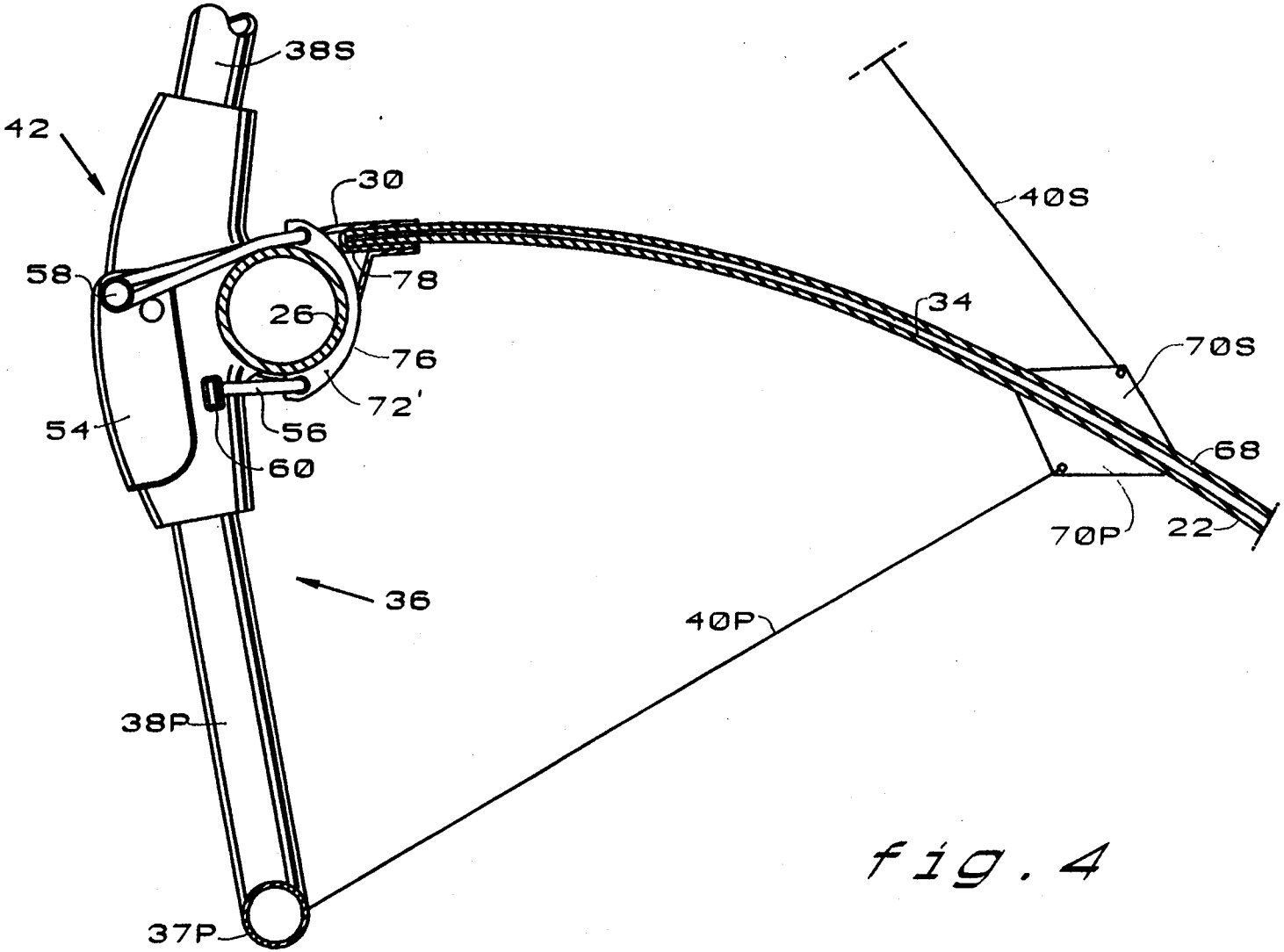
FIG. 4 is view in detail of a third preferred embodiment of the camber controlling mechanism of the present invention of the portion indicated by the section lines 2—2 in FIG. 1.

FIG. 4 shows a third preferred embodiment of forward camber handle 36 comprising vertical bars 37P, 37S, lever arms 38P, 38S, forward clamp 42, and clamp backing 72' with batten sliding surface 76, but not having batten restraining flanges 74. Small circumference Sleeve 30 attaches to sail body 22. A batten restraining strap 78 is secured over sail body 22 and over batten end 80 of control batten 34.

Figure 5A:
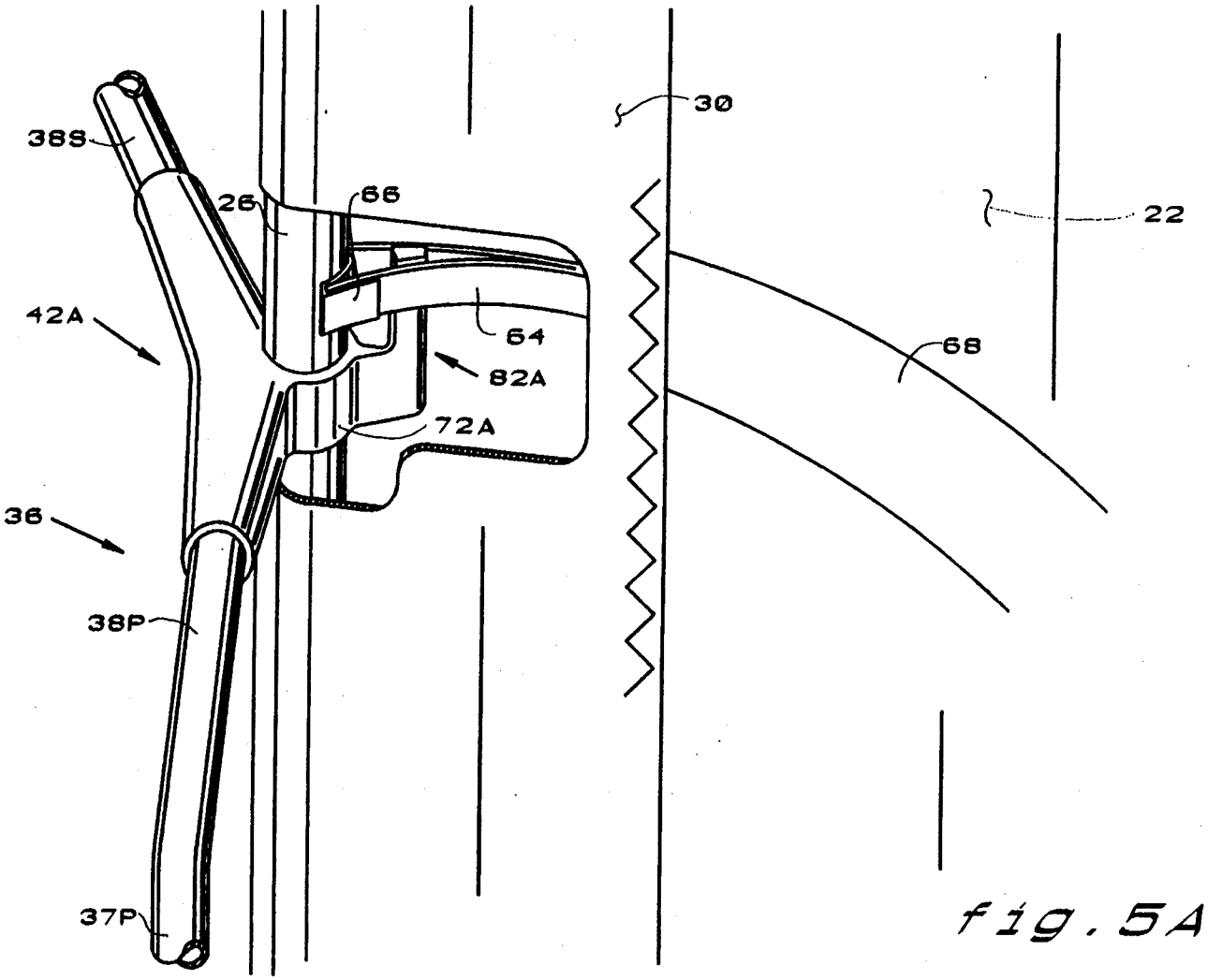
FIG. 5A is side elevation view in detail of a fourth preferred embodiment of the camber controlling mechanism of the present invention of FIG. 1.

FIG. 5A shows a fourth preferred embodiment of forward camber handle 36 comprising vertical bars 37P, 37S, lever arms 38P, 38S, a forward clamp 42A, and a camber bar 82A extending forward from a clamp backing 72A, which can be machined or molded with forward clamp 42A. Camber bar 82A extends between batten fork 64 which is enclosed within Sleeve 30 (shown cut away).

Figure 5B:
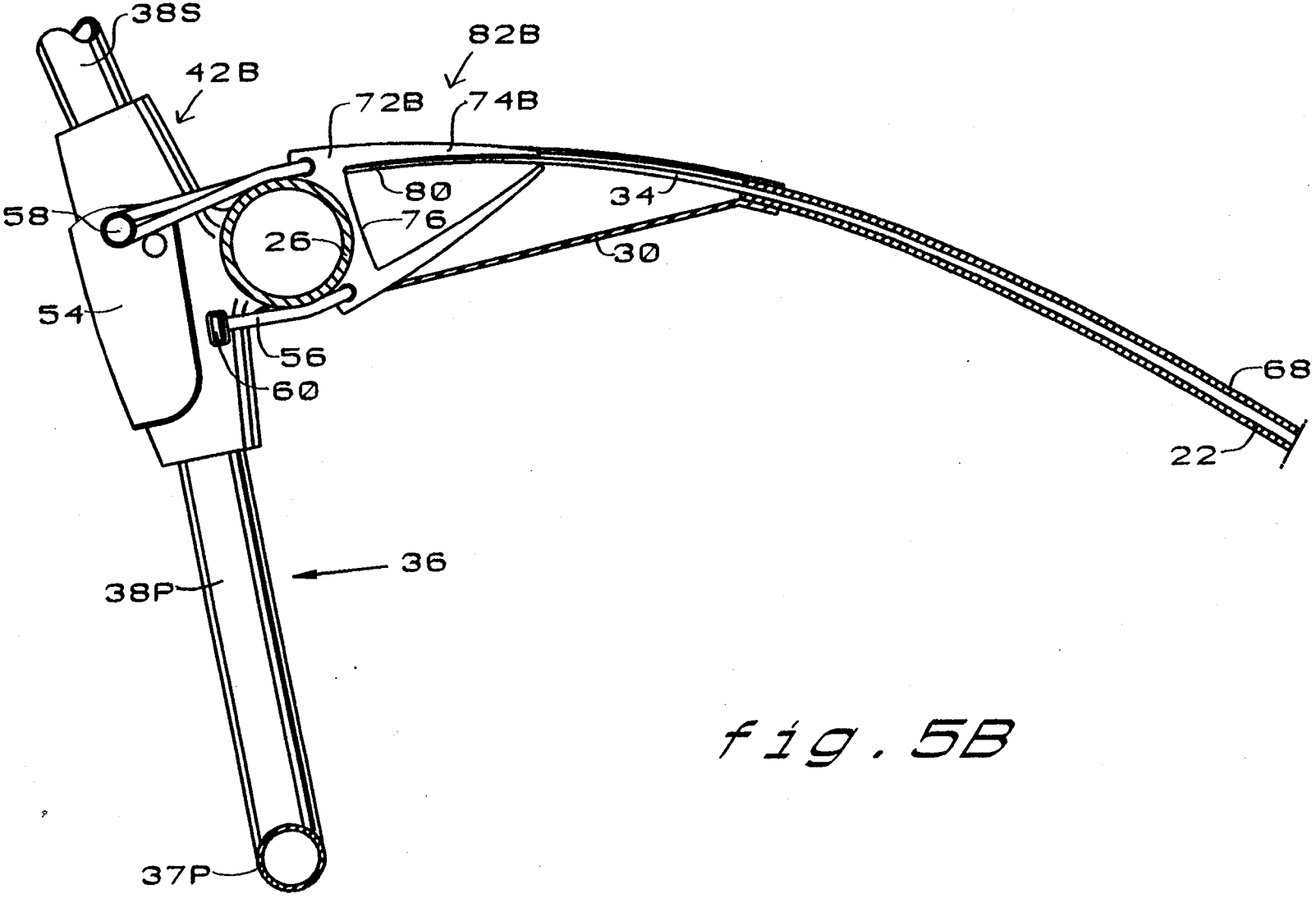
FIG. 5B is view in detail of a fifth preferred embodiment of the camber controlling mechanism of the present invention of the portion indicated by the section lines 2—2 in FIG. 1.

FIG. 5B shows a fifth preferred embodiment of forward camber handle 36 similar to the second preferred embodiment of FIG. 3. The differences include having a camber bar 82B in the form of a pair of batten restraining flanges 74B which extend aft from a clamp backing 72B and converge to a narrow gap on either side of control batten 34. There is also a lack of control lines 40P, 40S. A forward lever clamp 42B may allow lever arms 38P, 38S to angle slightly forward.

Figure 6B:
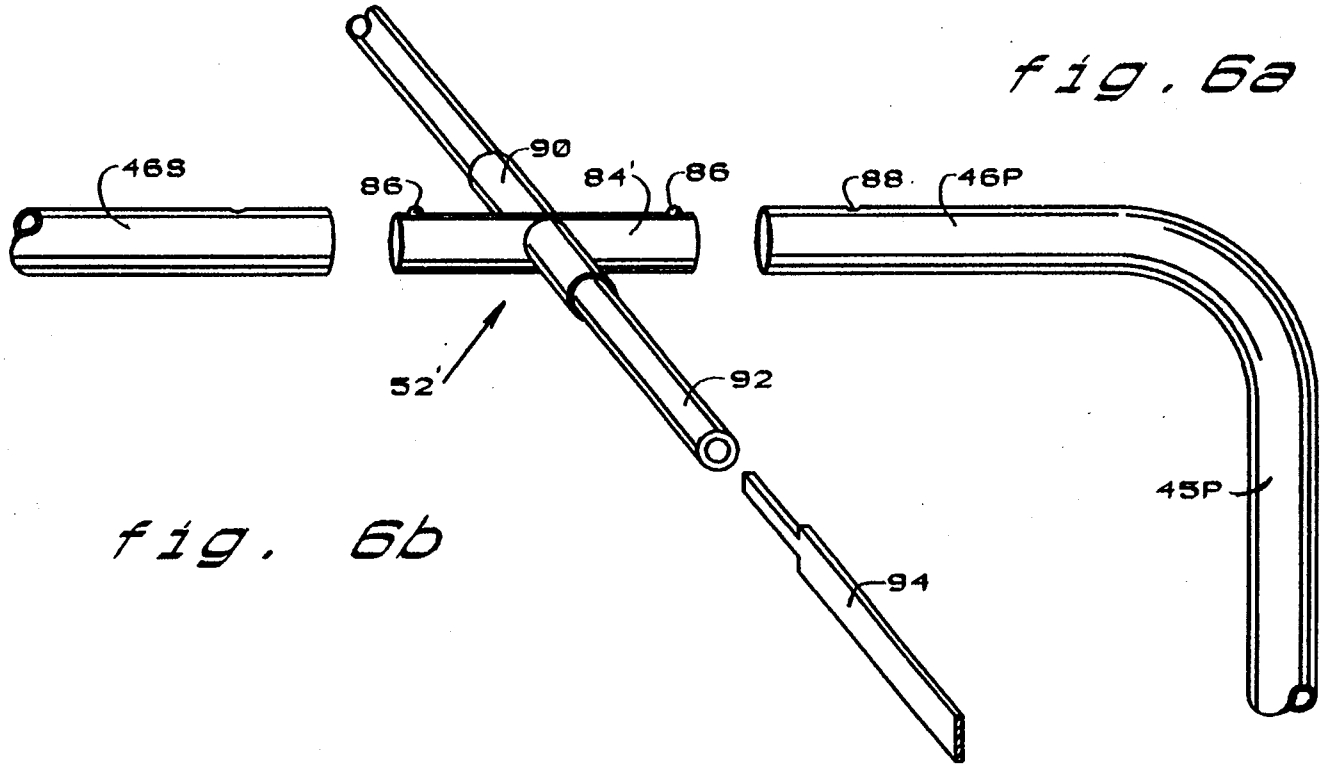
FIG. 6*b* is a front elevation view of a second preferred embodiment of the aft lever bracket assembly of the present invention.

FIG. 6*a* and 6*b* show preferred embodiments of aft lever bracket assembly 52. Referring first to FIG. 6*a*, a port and a starboard aft lever bracket 50P, 50S are secured to either side of sail body 22, batten pocket 68 and over control batten 34 with rivets or other fasteners (not shown). Brackets 50P, 50S can be formed from aluminum plate, and a bracket tubes 84 can be aluminum tubing welded on. Bracket tubes 84 have a spring pin 86 mounted through their wall to retain aft arm 38 which has a spring pin hole 88 drilled through its wall.

FIG. 6*b* shows bracket assembly 52' which comprises bracket tube 84' and a batten tube 90. Batten tube 90 can be placed through a hole drilled through bracket tube 84' and welded in place. Bracket assembly 52' is placed through holes in sail body 22 and batten pocket 68 on sail 20 before control batten 34L or 34U is slid into batten pocket 68 and through batten tube 90. Forward batten portion 94 is a tapered plank batten having the aft end notched to fit into tubular batten shaft 92.

Figure 7:
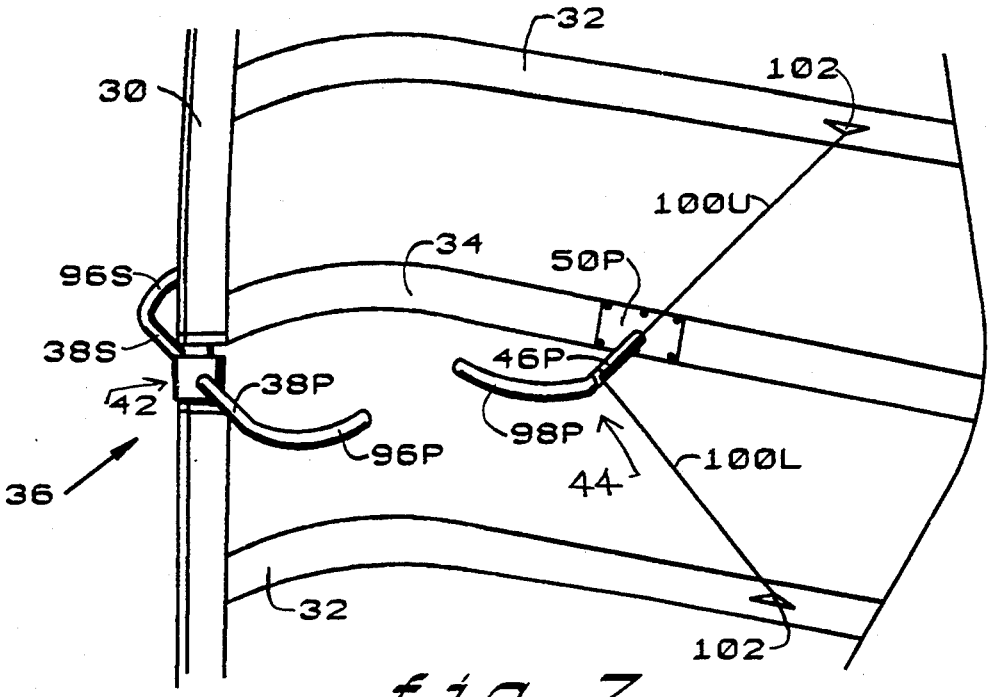
FIG. 7 is a side elevation view of a sixth preferred embodiment of the present invention.

Referring to FIG. 7 is a further preferred embodiment of forward and aft camber handles 36 and 44. Forward handle 36 comprises forward clamp 42, and a port and a starboard forward horizontal bar 96P and 96S attached to lever arms 38P and 38S, respectively, and extending generally aft. Aft handle 44 comprises bracket assembly 52, and a port aft horizontal bar 98P, attached to aft arm 46P, and extending generally forward. An upper and a lower aft lever stay 100U and 100L are attached to aft arm 46P and extend above and below control batten 34 to a couple of stay anchors 102 on the sail body 22 or batten pockets 68 in close vicinity to battens 32.

Figure 9:
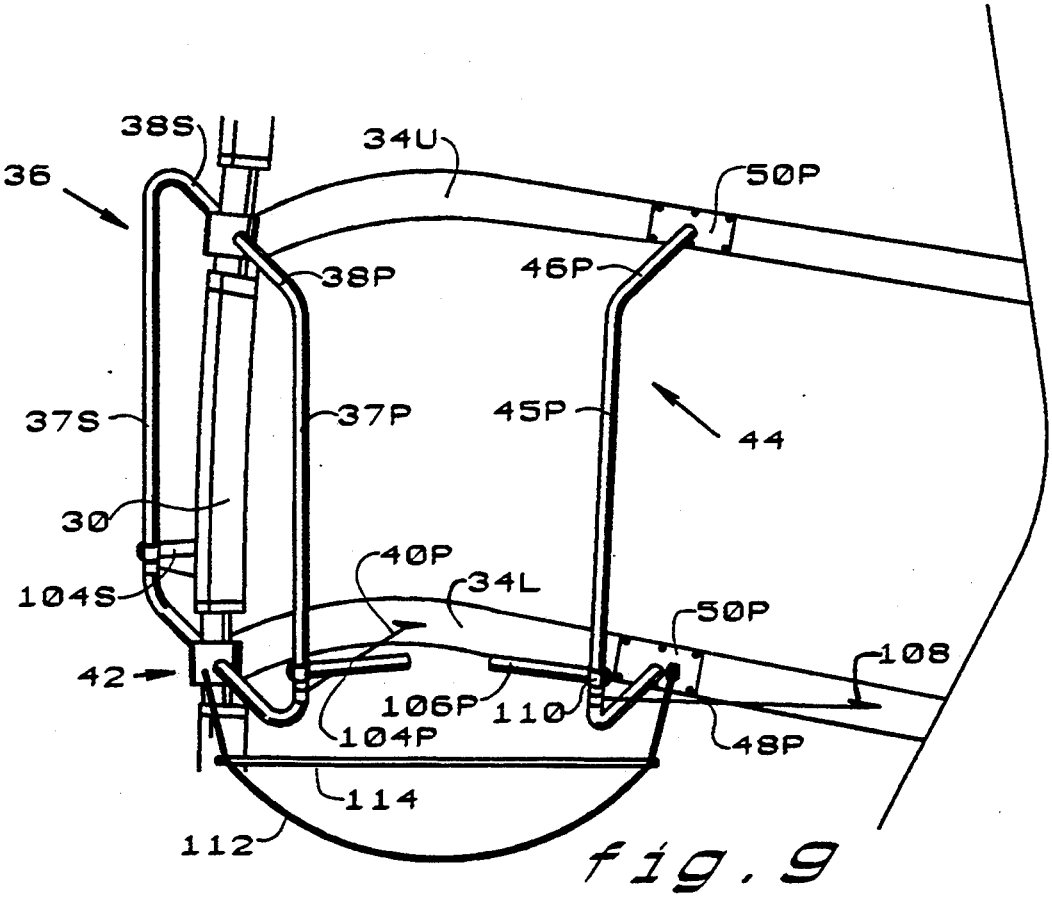
FIG. 9 is a side elevation view of the present invention showing the camber lever extensions and a harness line system.

Referring to FIG. 9, a side elevated view of a portion of sail 20 shows a port and a starboard forward handle extension 104P and 104S, attached to respective forward vertical bars 37P and 37S, and extending generally in the aft direction. A port aft handle extension 106P is attached to aft vertical handle 45P, and extends generally forward. Also shown is aft control line 48P extending from aft vertical bar 45P to an aft control line anchor 108 which is fixed to sail body 22 along control batten 34L. Handle extensions 104P, 104S, and 106P are attached by a plurality of clamping mechanisms 110 to the vertical bars 37P, 37S, and 45P, respectively.

Also shown is a harness line 112 and a harness line spreader 114. Harness line 112, which can be a polyester rope, attaches at one end to an eye or other fitting molded or fixed onto forward clamp 42L (not shown). The other end of harness line 112 attaches to an eye or other fitting fixed to aft bracket assembly 52. Spreader 114 is a rigid lightweight tube which can be constructed of a carbon fiber composite with a hole near each end through which harness line 112 passes. Spreader 114 is usually of a length approximate to the distance between forward clamp 42L and aft bracket assembly 52.

Figure 10C:
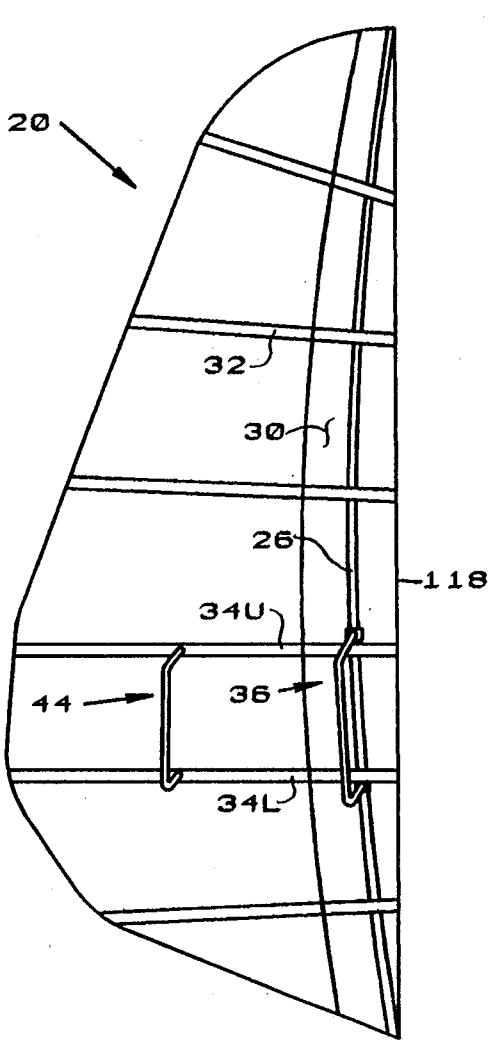
FIG. 10*c* is a side elevation view of the present invention showing a third preferred embodiment of the sail having a leading edge extending forward of the mast.
Figure 10B:
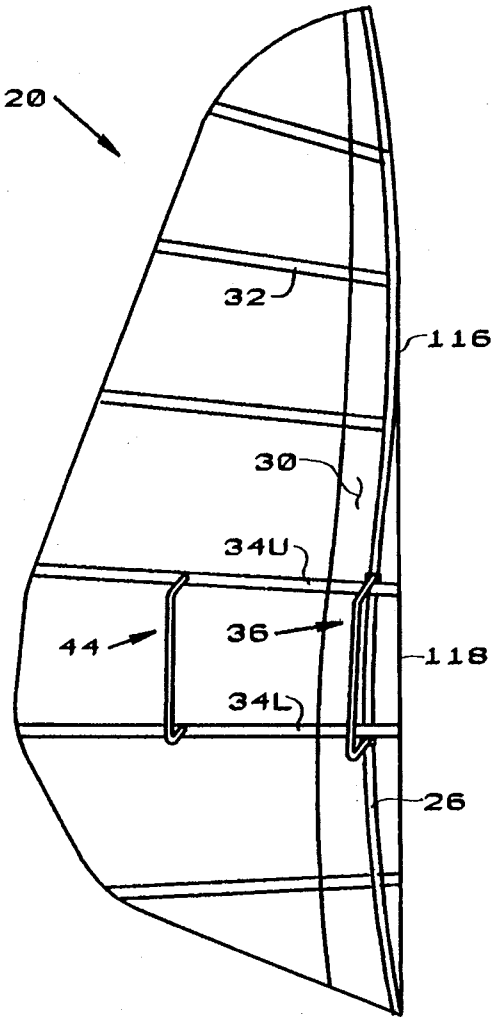
FIG. 10b is a side elevation view of the present invention showing a second preferred embodiment of the sail having a leading edge extending forward of the mast.
Figure 10A:
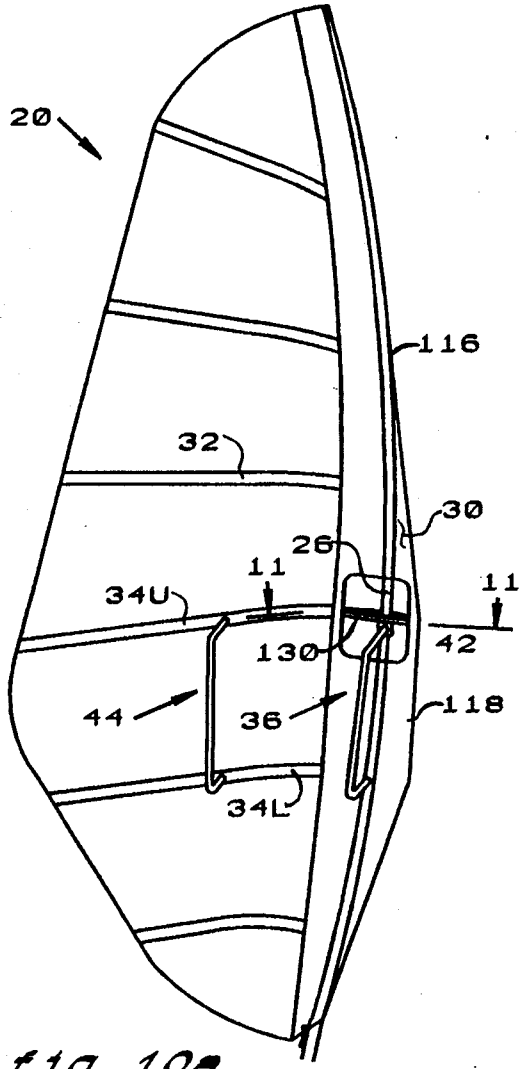
FIG. 10*a* is a side elevation view of the present invention showing a first preferred embodiment of the sail having a leading edge extending forward of the mast.

FIG. 10*a*, 10*b*, and 10*c* show further embodiments of the invention employing a forward extending leading edge. In FIG. 10*a*, sail 20 bends the ends of mast 26 aft. Sleeve 30 has a leading edge 118 that extends forward of mast 26 from the tack to an upper height where sail leading edge 118 meets mast 26 at a mast-sleeve tangency 116. Leading edge 118 will generally be constructed of a low stretch fabric such as one made of aramid fibers. Forward handle 36 will attach to mast 26 through openings in Sleeve 30. Control battens 34U, 34L may each engage with a flexible rib 130 shown in FIG. 11, or with a rigid rib 132 as shown in FIG. 12. Leading edge 118 may have broad seaming to make the sections concave, straight or convex along its length from the tack to mast-sleeve tangency 116 as viewed from the side. From mast-sleeve tangency 116 to the sail head, Sleeve 30 curves aft maintaining forward contact with mast 26.

FIG. 10*b* shows sail 20 bending mast 26 into an "S" shape. Sleeve 30 has leading edge 118 that extends forward of mast 26 from the tack to mast-sleeve tangency 116. From mast-sleeve tangency 116 to the sail head, Sleeve 30 curves aft maintaining forward contact with mast 26.

FIG. 10*c* shows sail 20 bending ends of mast 26 forward with Sleeve 30 having leading edge 118 extending forward of mast 26 the entire length from the tack to the head of sail 20.

Figure 11:
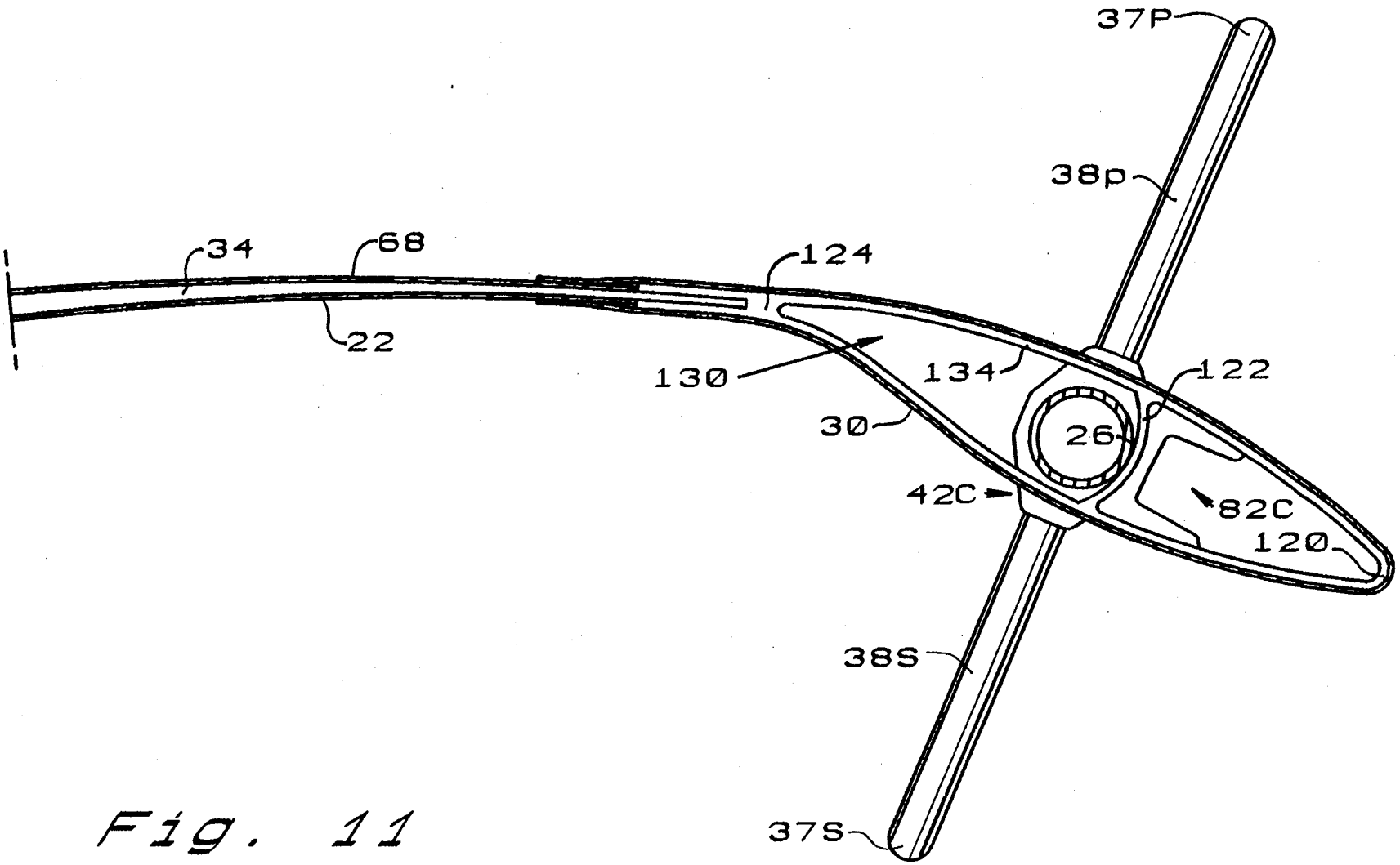
FIG. 11 is a top view in detail of a first preferred embodiment of the present invention for the mast/sail geometry of FIG. 10*a* through FIG. 10*c* indicated by the lines 11—11 in FIG. 10*c*.
Figure 12:
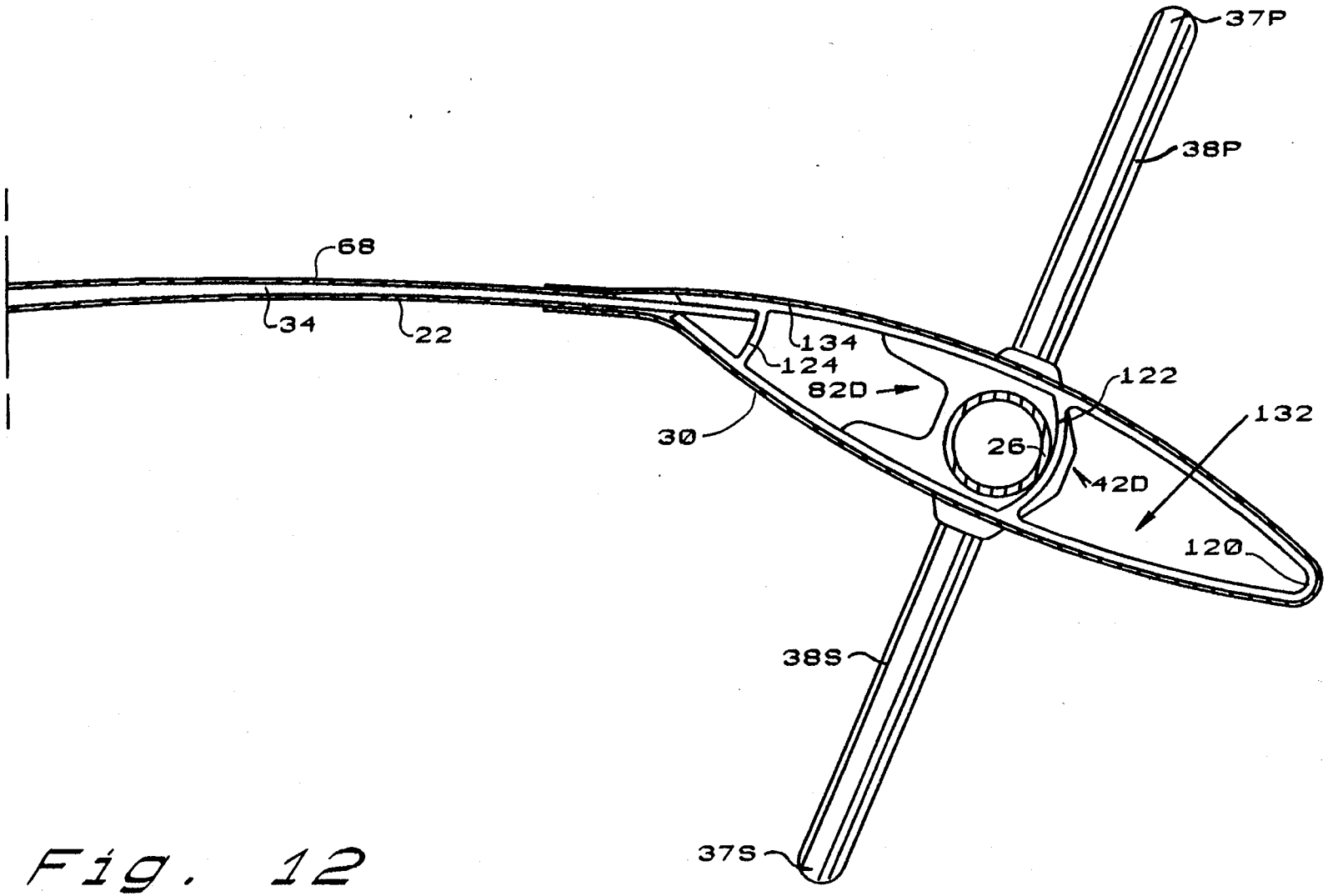
FIG. 12 is a top view in detail of a second preferred embodiment of the present invention for the mast/sail geometry of FIG. 10*a* through FIG. 10*c* indicated by the lines 11—11 in FIG. 10*c*.

Referring now to FIG. 11, the details of a flexible rib 130 will be discussed. Forward camber handle 36 is shown connecting a forward clamp 42C which is fixed to mast 26. Forward clamp 42C extends through openings in port and starboard sides of Sleeve 30. Flexible rib 130 will have a pair of rib battens 134 that pass forward across both sides of mast 26 and converge at leading edge 118 with a rib nose 120. A pair of camber bars 82C are molded to forward clamp 42C and extend forward engaging each rib batten 134. Aft ends of rib battens 134 connect with control batten 34 at a position within Sleeve 30 or at some position aft of Sleeve 30. Control batten 34 may engage flexible rib 130 by sliding in between each rib batten 134 and butting against a batten restraining web 124 fixed between rib battens 134 forward of their aft ends. Alternatively, rib battens 134 may be fixed to control batten 34 by utilizing an adhesive or other fastener. A mast web 122 is mounted between each rib batten 134 somewhat aft of rib nose 120 and forward of mast 26, and can be a woven webbing affixed to rib battens 134. Alternatively, entire flexible rib 130 and can be molded as one piece, including batten restraining web 124, rib nose 120, and mast web 122 from a tough and resilient plastic such as polypropylene.

FIG. 12 shows the details of a rigid rib 132 which is similar to flexible rib 130. The primary difference is the rigidity of structure, and batten restraining web 124 acts as a batten sliding surface for the forward end of the control batten 34. A pair of camber bars 82D are shown pointing aft rather than forward as in FIG. 11. Rigid rib 132 can be constructed of a carbon fiber composite or molded from plastic. A clamp 42D secures to mast 26.

Figure 13:
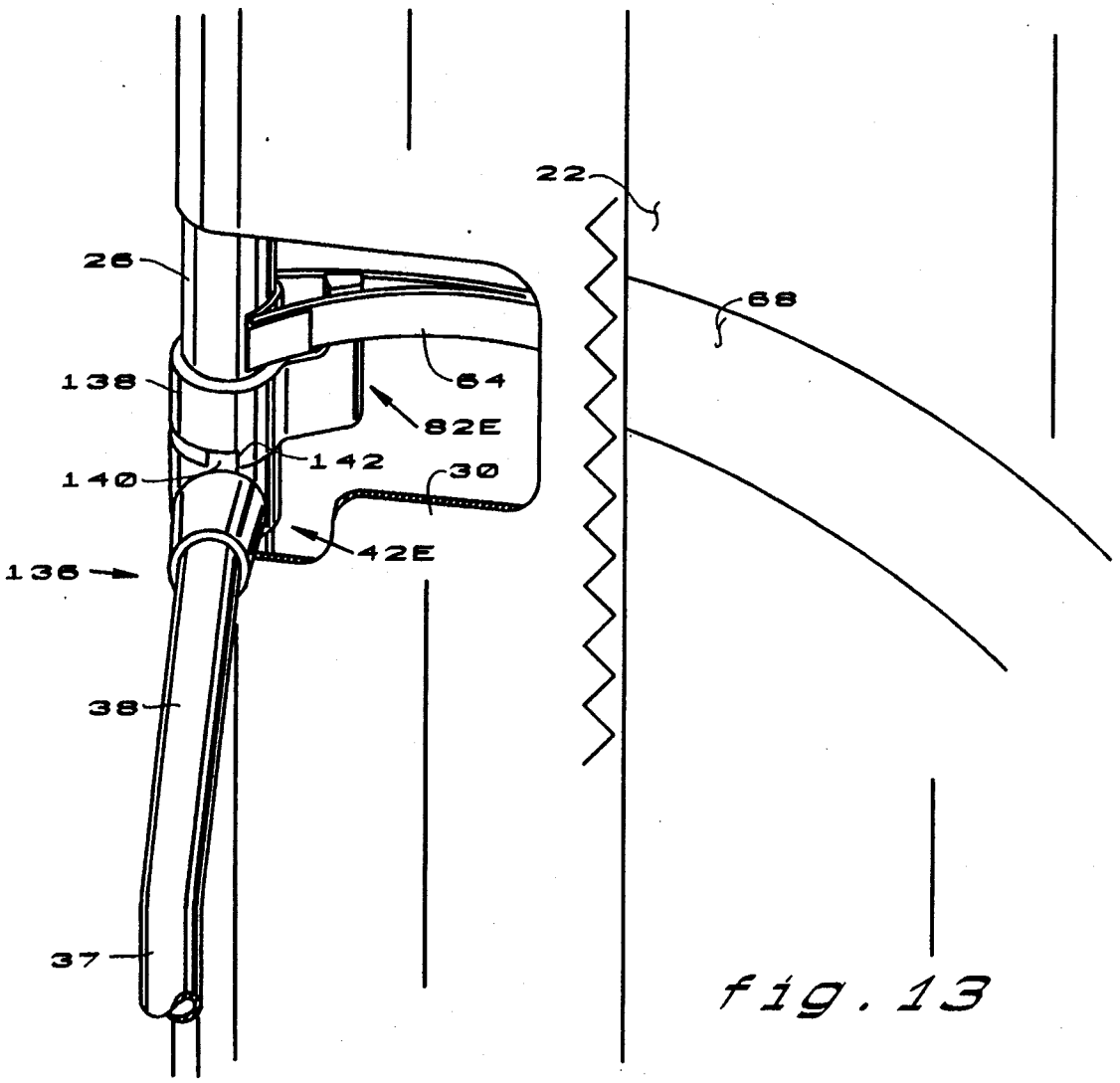
FIG. 13 is a side elevation view of the present invention showing another preferred embodiment of the forward swing camber handle.

Referring finally to FIG. 13, a swing camber handle 136 is shown. Swing camber handle 136 comprises forward lever clamp 42E, forward lever arm 38, and forward vertical bar 37. A camber bar clamp 138, comprises a camber bar 82E which can be molded with bar clamp 138. Bar clamp 138 has a notch 142 in the edge facing lever clamp 42E. Forward lever clamp 42E further comprises a cog 140 extending within notch 142.

OPERATION OF INVENTION

Figure 8A:
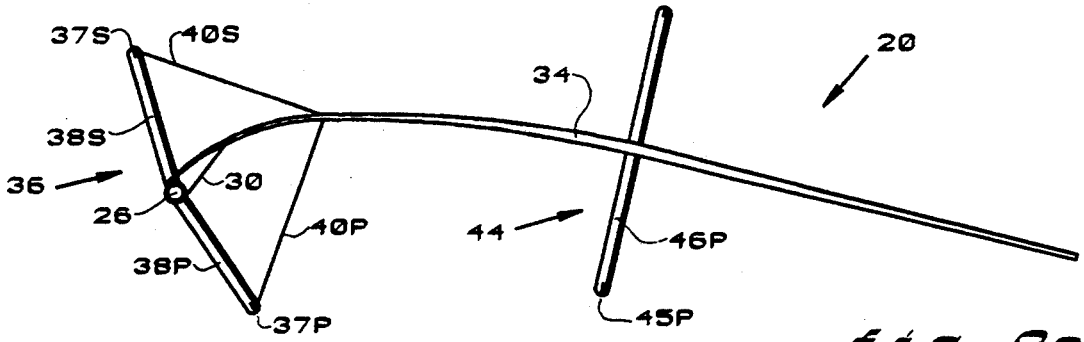
FIG. 8*a* is a top plan view of the present invention showing a high camber geometry.

Referring initially to FIG. 1, the present invention is shown from the side on a port tack sailing orientation. The sailor grasps forward vertical bar 37P with his left hand and aft vertical bar 45P with his right hand. Sail 20 can be pivoted about universal joint 28 in all directions as is well known in the art. For instance, raking, heeling, and angle of attack of sail 20 are all accomplished by applying forces to forward and aft vertical bars 37P and 45P in much the way forces applied to a wishbone boom will accomplish movements of prior art sails in windsurfing. With this structure, the sail center of effort lies between forward vertical bar 37P and aft vertical bar 45P at a vertical position at or close to control batten 34U. When the sailor pushes forward and aft vertical bars 37P and 45P towards each other, the camber of the control battens 34L, 34U will increase by a corresponding amount, which is best shown in FIG. 8*a*. Likewise, pulling forward and aft vertical bars 37P and 45P away from each other, will decrease sail camber by a corresponding amount as shown in FIG. 8*c*. In this way the sailor can optimize the sail camber instantaneously and with little effort for the immediate wind condition and sailing objective at hand. When a strong gust of wind hits sail 20, the camber can be reduced instantaneously while maintaining a constant angle of attack if desired. It will be appreciated that forward handle 36 can prevent the sails leading edge portion, or luff, from collapsing to a much greater degree than with the prior art. The control of the sail luff is possible since forward handle 36 directly controls the angular rotation of the control battens 34 about mast 26 to hold desired positions relative to the wind. Furthermore, aft handle 44 controls the aft portion of sail 20 and can allow the aft portion of control batten 34 to fall off, thereby keeping the center of effort from moving aft in sail 20. Therefore, much greater control of the sail will be maintained than with prior art sails. With out having a wishbone boom, sail 20 can be made as light or lighter than prior art sails.

Figure 8B:
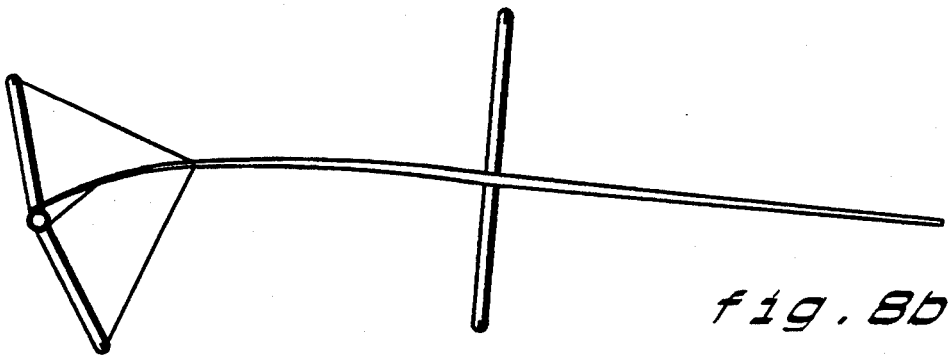
FIG. 8*b* is a top plan view of the present invention showing a moderate camber geometry.
Figure 8C:
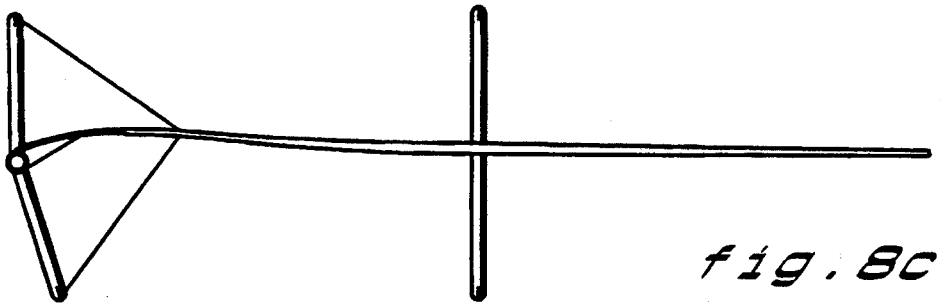
FIG. 8*c* is a top plan view of the present invention showing a very low camber geometry.

FIG. 8*a* through FIG. 8*c* are top sectional views of sail 20 comprising forward handle 36 , mast 26, Sleeve 30, control batten 34, forward control lines 40P, 40S, and aft camber handle 44. FIG. 8*a* shows sail 20 in a high camber state. FIG. 8*b* shows sail 20 in a moderate camber state, while FIG. 8*c* shows the sail 20 in a very slight camber state with some reflex camber.

Referring to FIG. 8*b*, the control of the sail camber will be discussed further. With sail 20 under a moderate wind loading, an equilibrium of sail camber will be reached. The air pressure acting on sail 20 will tend to increase camber in control battens 34, and the sailor's applied forces to forward and aft handles 36, 44, will tend to reduce camber in control battens 34. Some of the factors that will determine the sail camber at equilibrium include the designed angle of forward and aft handles 36, 44 relative to control battens 34, the distance from mast 26 of aft handle 44, and the flexibility of control battens 34. To obtain sail camber different than that at equilibrium, the sailor need apply horizontal forces to forward and aft handles 36, 44. For fine tuning of the configuration of forward arms 38P and 38S, prior to sailing, it is contemplated that the angle between the them be adjustable. This can be accomplished by having forward arm 38P secured into one clamp 42, while forward arm 38S is secured into another adjacent clamp 42.

A variation of control batten 34 can have a more flexible section at the attachment point of aft handle 44, or aft of it. When aft control lines 48 are utilized, the aft portion of control batten 34 can be cambered when sufficient torque is applied to aft handle 44.

During wave jumping, the sailor can position his hands higher on forward and aft vertical bars 37, 45, thereby placing his body mass in closer proximity to the sail center of effort. Sail 20 can then be utilized to provide the sailor with lift for greater hang time and altitude, without pitching the sailor/sail/board system forward.

Referring now to FIG. 2, the details of forward handle 36 will be discussed. Forward clamp 42 is secured to mast 26 so that torque applied to forward vertical bar 37P in the counter clockwise direction will cause mast 26 to rotate counter clockwise. This mast rotation will in turn rotate the tack and head of sail 20 so that a smoother leeward surface is created towards these ends. Concurrently, line 40S will pull control batten 34 to leeward and forward, thereby imparting a bending moment on it. Batten fork 64 is restrained from forward movement against mast 26 by restraining strap 66. Batten fork 64 thereby has an additional bending moment from compression against mast 26, and will therefore rotate about it. If forward control lines 40 were rigid, then the formation of camber by control battens 34 would be diminished. Rotation of forward handle 36 in the clockwise direction will reduce camber. Further clockwise rotation will cause line 40P to reduce the camber more, yet continue to pull control batten 34 forward to maintain some forward camber. Even further rotation of forward handle 36 in the clockwise direction will cause control batten 34 and sail body 22 to bend to the opposite side for the starboard tack. The forward end of line 40 can be attached to forward arm 38 rather than forward vertical bar 37. In so doing, line 40 clears sailor hand movement along forward vertical bar 37.

FIG. 3 shows the use of tapered control batten 34 that engages with clamp backing 72. In this preferred embodiment of forward handle 36, the forward end of control batten 34 is restrained from forward movement towards mast 26 by sliding surface 76. Restraining flange 74S provides resistance to lateral movement of control batten 34 to leeward so that it will bend when forward handle 36 is rotated in the counter clockwise direction from the tension from line 40S. Sliding surface 76 allows control batten 34 to slide to the opposite side during tacking of sail 20.

FIG. 4 shows clamp backing 72' that has sliding surface 76, however, there is no restraining flange 74 as in FIG. 3. Instead, Sleeve 30 is of a small circumference slightly greater than the circumference of mast 26. Control batten 34 is restrained from forward movement relative to sail 20 by restraining strap 78 that is fixed to the sail body 22. When forward handle 36 is rotated counter clockwise, control line 40S will pull control batten 34 to leeward and small circumference Sleeve 30 provides lateral resistance thereby bending control batten 34. Clamp backing 72' is thicker towards the windward and leeward ends. When control batten 34 rotates about clamp backing 72' the increased tension from Sleeve 30 will limit the rotation of control batten 34.

Alternatively, forward clamp 42 can be vertically adjacent control batten 34 so that it does not provide any resistance to movement of control batten 34.

FIG. 5A shows another variation of forward handle 36. Here camber bar 82A engages batten fork 64 for rotational movement about mast 26. With the use of camber bar 82A it is not necessary to use lines 40S, 40P. When the sailor pulls forward vertical bar 37P aft, camber bar 82A will rotate batten fork 64 to leeward to increase sail camber. In this case, forward arms 38P and 38S can be angled forward to affect a greater change in camber. It will be appreciated that camber bar 82A can be used in conjunction with camber inducing mechanisms that are well known in the prior art such as that described in Magnan U.S. Pat. No. 4,708,079, or Magnan U.S. Pat. No. 4,856,447, rather than with battens forks 64. The angle desired between each forward arm 38P and 38S will vary according to the length camber bar 82A extends from mast 26 and the amount of camber desired in sail 20.

It would also be possible to have a camber bar extend externally to control batten 34 as shown in FIG. 5B. Camber bar 82B is split into batten restraining flanges 74B, where each flange 74B extends to opposite sides of control batten 34. The load transfer of forces from control batten 34 to mast 26 is facilitated by camber bar 82B. Flanges 74B impart a bending moment on control batten 34 when forward handle 36 is rotated enough in either direction about the vertical axis of mast 26. Forward control batten end 80 can slide on surface 76 when switching tacks.

Referring now to FIG. 6*a*, the operation of bracket assembly 52 will be discussed. Aft brackets 50P, 50S are formed to fit over each side of control batten 34, sail body 22 and batten pocket 68 so that there is little or no lateral play between control batten 34 and brackets 50P, 50S. With the brackets 50P, 50S secured to sail 20 , control batten 34 can be installed or removed from sail 20 by sliding it in or out from bracket assembly 52. Bracket tubes 84 can have rounded plugs in each end to provide an anti chafing surface for sail body 22 when the sail is rolled up for storage. Aft arms 46 are slid over bracket tubes 84 with spring pin 86 engaging spring pin hole 88 to retain aft arm 46 in place. With this construction, aft handles do not need aft control lines 48 if control battens 34 are stiff enough. However, a weight savings can be realized by utilizing aft control lines 48 since they will help stay control battens 34.

Bracket assembly 52' of FIG. 6*b* is not directly secured to sail body 22. Bracket assembly 52' is held directly to control batten 34 having batten shaft 92. Fore and aft movement of batten tube 90 along batten shaft 92 can be restrained by a clamping mechanism such as a collar with an adjustable screw.

Operation of Forward and Aft Horizontal Bars 96, 98. Referring to FIG. 7, the use of forward and aft horizontal bars 96, 98 is contemplated for use with a greater emphasis on speed sailing. Since the emphasis is for racing rather than wave jumping, the sailor need not align his body mass to the sail center of effort. Instead, forward and aft camber handles 36,44 are placed at an appropriate height on sail 20 thereby reducing weight and aerodynamic drag. Stays 100 are utilized to keep aft handle 44 from rotating about its horizontal axis, and to help control the sail camber. Forward handle 36 of FIG. 7, can utilize any of the preferred embodiments described for FIG. 2 through FIG. 5B.

Alternatively, forward and aft vertical bars 37, 45 of FIG. 1 can be shortened to reduce weight and aerodynamic drag when wave jumping is not the priority. Also, the lever arms 38, 46 can be of an aerodynamic foil section to reduce drag.

Forward and aft handle extensions 104P, 104S, and 106P are shown in FIG. 9. Forward and aft handle extensions 104P, 104S, 106P are utilized so that hand placement in the fore and aft directions can be further optimized during various sailing conditions. Clamping mechanisms 110 allow adjustment along vertical bars 37 and 45.

Harness line 112 and spreader 114 are illustrated in FIG. 9. As with the prior art, harness line 112 is used to reduce loading on the sailor's arms by distributing the load to the sailor's body via a harness. Harness line 112 has spreader 114 that prevents the ends of harness line 112 from pulling towards each other, which would otherwise tend to increase the sail camber as the wind load increases.

Operation of Flexible Ribs

FIG. 11 shows flexible rib 130 within Sleeve 30 engaged with control batten 34. Mast web 122 restrains mast 26 from forward movement relative to Sleeve 30 when sail 20 is placed under a wind load. When sail 20 is under a wind loading the upper portion of mast 26 will tend to bend aft and to leeward, however, leading edge 118 will stay mast 26 to help it resist bending. Mast web 122 in conjunction with rib battens 134 act as a spreader for leading edge 118 keeping leading edge 118 distant from mast 26. In this way it is possible to use a mast that is lighter than would be necessary without this staying effect of leading edge 118. There is no mast web on the aft side of mast 26 as this is not necessary as with camber inducer or split batten sails of the prior art. Control battens 34 are restrained from forward movement relative to mast 26 while under wind loading since leading edge 118 exerts a force to push flexible rib 130 aft against mast 26. Camber bars 82C extend forward to engage with rib battens 134. Rotation of forward handle 36 will rotate camber bars 82C and flexible rib 130 with it. This will also bend control batten 34 into an efficient foil shape. In effect, the forward portion of control batten 34 is rotated about a vertical axis that is defined by the ends of mast 2,6.

Control batten 34 together with flexible rib 130 can be installed into sleeve 30 and into batten pocket 68 from a zippered opening in sleeve 30. Compression on control batten 34 and flexible rib 130 can be adjusted by a webbing buckle located on the sail leach that is well known in the prior art. Rib battens 134 can be held in place in sleeve 30 by hook and loop type coverings (not shown) within Sleeve 30. By securing sleeve 30 to rib battens 134, the windward side of sleeve 30 will be made to conform to flexible rib 130. Alternatively, rib battens 134 need not be secured to sleeve 30, and sleeve 30 can slide about mast 26 to develop a flatter windward surface.

Operation of Rigid Rib

In FIG. 12, rigid rib 132 operates in a similar way to flexible rib 130 with the difference that the forward end of control batten 34 will rotate between the aft ends of rigid rib 132 until being restrained against leeward rib batten 134 in much the way battens function with camber inducers. It will be emphasized that control battens 34 of FIG. 11 and FIG. 12 do not achieve a cambered state by having an initial compression against mast 26 as with camber inducers. The camber is controlled from torque applied from forward handle 36 which rotates camber bars 82D against rigid rib 130 which then bends, or counters bending of control batten 34. Restraining web 124 will act as a sliding and forward restraining surface for the forward end of control batten 34.

Operation of Forward Extending Leading Edge Sails

FIG. 10*a* shows sail 20 bending mast 26 aft. Leading edge from bending further aft for the portion of mast 26 that extends from tack to mast-sleeve tangency 116. From mast-sleeve tangency 116, the head end of mast 26 is free to bend. This will allow some twist in sail 20 as is well known in the prior art.

In FIG. 10*b*, mast 26 will be considered to be bent forward for the portion extending from the tack to the mast-sleeve tangency 116. This will, in effect, create an anhedral wing for this forward bending section while for the portion of mast 26 extending from mast-sleeve tangency 116 to the head, there will be a dihedral wing portion. As in FIG. 10*a*, the upper portion of mast 26 will be free to bend aft and to leeward allowing more sail twist. The stayed portion of mast 26 of FIG. 10*b* will be more effectively stayed than for the similar section of mast 26 of FIG. 10*a*.

In FIG. 10*c*, entire mast 26 is bent forward and leading edge 118 is very effective in staying mast 26. In this configuration the mast structural requirements will be less than either mast 26 of FIG. 10*a* or FIG. 10*b*, so that a lighter mast will be adequate.

Operation of Forward Swing Handle

FIG. 13 shows forward lever arm 38 secured into clamp 42E which encircles mast 26 and can rotate about mast 26. In this embodiment, only one vertical bar 37 is necessary as swing handle 136 will engage with camber bar 82E on either the port or starboard tack. When swing handle 136 is rotated to the port side, cog 140 will contact the port edge of notch 142. Further rotation of swing handle 136 will cause rotation of camber bar clamp 138 and mast 26 to which it is tightly secured (clamping mechanism on camber bar clamp 138 is not shown for clarity). Camber bar 82E will bend split batten 64 and increase sail camber with further rotation aft of swing handle 136. Control battens 34 for this embodiment will usually be slightly stiffer. When less camber is desired, rotation of swing handle 136 forward will allow control batten(s) 34 to de-camber, even against a strong wind loading. Swing handle 136 can rotate freely to starboard until encountering the starboard edge of notch 142. Further rotation to starboard will engage bar 82E for rotation of mast 26 and split batten 64 for the starboard tack. In this way, the sailor need not switch hand grips between port and starboard forward handles during tacking and jibing. Also, the weight of sail 20 can be reduced and there will be a reduction in aerodynamic drag with this embodiment.

Another embodiment of the swing handle would utilize a clutch mechanism. The clutch mechanism (not shown) would engage forward lever clamp 42 with camber bar clamp 138. With lever clamp 42 clutched to bar clamp 138, swing handle 136 can rotate bar 82 in either direction to increase or decrease sail camber. Releasing the clutch mechanism would allow free rotation of swing handle 136 about mast 26. A clutch release lever (not shown) can be placed conveniently on vertical bar 37 with a clutch cable running to the clutch.

Conclusion, Ramifications, and Scope of Invention

Consequently, the reader will see that the camber handles of the invention provide a lightweight, practical, strong, and effective device for the active control and variation of sail camber while under way, thereby allowing appropriate camber states for various sailing objectives, and an increased wind speed range in which the sail is efficient and controllable. Furthermore, the invention makes possible the alignment of sailor mass to sail center of effort while jumping for greater altitude and hang time.

While the foregoing description contains many specificities, these should not be construed as limitations on the scope of the invention, but rather as an exemplification of some preferred embodiments thereof. Many other variations are possible. An example would be that of a mast 26 having a small ridge along its length so that flexible ribs 130 or rigid ribs 132 will engage with mast 26 and will rotate as forward camber control handle 36 is rotated. Another variation would be mast 26 having a groove along the aft side into which control battens 34 and battens 32 could be inserted. Load transfer, utilizing a groove, from control battens 34 to mast 26 would effect bending of control battens 34. It will also be appreciated that the rotation of mast 26 with forward handle 36 is not necessary for all the embodiments of this invention, however, this rotation will allow more efficient aerodynamics.

Accordingly, the scope of the invention should be determined not by the embodiments presented, but by the appended claims and their legal equivalents.

Camber Control Sail System

I claim,

1. A sail system for wind propelled vehicles comprising:
   (a) a mast;
   (b) a sail, the luff portion of which is attached to said mast;
   (c) a forward camber control handle extending from the forward portion of said sail;
   (d) an aft camber control handle extending from said sail aft of said forward control handle;
   (e) whereby said sail and sail camber is controlled by grasping said forward and aft camber control handles and moving said control handles relative to one another.

2. A sail system for wind propelled vehicles according to claim 1, wherein a set of said forward and aft camber control handles extend one from each the port and starboard side of said sail.

3. A sail system for wind propelled vehicles according to claim 2, wherein said forward camber control handles are affixed to said mast.

4. A sail system for wind propelled vehicles according to claim 3, further comprising an attachment means for securing said forward control handle to said mast such that lateral forces acting on said forward handle effect rotation of said mast.

5. A sail system for wind propelled vehicles according to claim 4, wherein said attachment means comprises an adjustable clamp.

6. A sail system for wind propelled vehicles according to claim 3, further comprising at least one control batten which traverses the length of said sail and intersects with said forward and aft camber control handles.

7. A sail system for wind propelled vehicles according to claim 6, further comprising a load transfer means for transferring loads from the forward section of said control batten to said mast and such that rotation of said forward control handle relative to said aft control handle effects bending of said control batten.

8. A sail apparatus for wind propelled vehicles according to claim 7, wherein said load transfer means comprises a grove along the aft face of said mast into which the forward end of said control batten is inserted.

9. A sail system for wind propelled vehicles according to claim 6, wherein said sail has a leading edge which extends beyond the forward face of said mast.

10. A sail system for wind propelled vehicles according to claim 1, wherein said forward control handle is secured to said mast by a means which permits said handle to rotate about the forward portion of said mast and two aft control handles extend one from each the port and starboard side of said sail.

* * * * *